US011105177B2

(12) United States Patent
Abdelmalek et al.

(10) Patent No.: US 11,105,177 B2
(45) Date of Patent: Aug. 31, 2021

(54) SYSTEM AND METHOD FOR SEALING A TUBING STRING

(71) Applicant: DOWNHOLE AND DESIGN INTERNATIONAL CORP, Houma, LA (US)

(72) Inventors: Adel Ghobrial Abdelmalek, Houma, LA (US); Lance Fry, Raceland, LA (US)

( * ) Notice: Subject to any disclaimer, the term of this patent is extended or adjusted under 35 U.S.C. 154(b) by 0 days.

(21) Appl. No.: 16/720,213

(22) Filed: Dec. 19, 2019

(65) Prior Publication Data

US 2021/0189829 A1 Jun. 24, 2021

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

2012/0292032 A1* 11/2012 Themig ..... E21B 34/12 166/310
2015/0226036 A1* 8/2015 Wolf ..... E21B 31/00 166/311

* cited by examiner

*Primary Examiner* — Kristyn A Hall
*Assistant Examiner* — Dany E Akakpo
(74) *Attorney, Agent, or Firm* — Ayoubip; Ahab S. Ayoub

(57) ABSTRACT

A sealing tool for sealing a tubing string at a predetermined location, the sealing tool having a prong assembly and a plug assembly, each of which includes a cavity configured to capture and retain debris, and the plug assembly including at least one equalization hole for fluid communication through the plug when unobstructed by the prong.

10 Claims, 5 Drawing Sheets

SYSTEM AND METHOD FOR SEALING A TUBING STRING

BACKGROUND OF INVENTION

Field of the Invention

The invention relates generally to a components for use in downhole pressure-testing operations.

Background

In a variety of hydrocarbon exploration and production operations, downhole tools are utilized to carry out desired tasks at locations within a wellbore. Different types of downhole tools may be utilized to drill wellbores, deploy tubing and other equipment downhole, perform testing operations, conduct servicing operations, and perform other tasks.

One such operation involves pressure-testing of downhole locations, typically within a tubing string. This is typically done by placing a plug within the wellbore to isolate the testing location.

In drilling locations having a substantial level of sand or other debris, sealing of the location may be hindered, and removal of the plug after testing the tubing string may be delayed, due to contamination within the wellbore which may interfere with the sealing and tool retrieval processes. In such instances, bailing of the debris must be performed resulting in costly delays. Accordingly, a need exists for a pressure-testing assembly capable operating reliably in the presence of sand or other debris.

SUMMARY OF INVENTION

In one aspect, embodiments relate to a sealing tool for a tubing string, comprising a prong assembly and a plug assembly. The prong assembly configured to penetrate into the plug assembly to seal one or more equalization holes thereof.

In one aspect, embodiments relate to a method for sealing a tubing string, comprising placing a plug having equalization holes into the tubing string, lowering a prong into the plug to seal the equalization holes, and capturing debris within a cavity disposed in at least one of the plug and the prong.

In one aspect, embodiments relate to a method for manufacturing a plug and a prong, comprising the placement and configuration of cavities to provide for the capture of debris during downhole operations.

Other aspects and advantages of the invention will be apparent from the following description and the appended claims.

BRIEF DESCRIPTION OF DRAWINGS

The drawings are provided to illustrate example embodiments described herein and are not intended to limit the scope of the disclosure.

DETAILED DESCRIPTION

For purposes of clarity, references to "upper" and "lower" parts of the embodiments described herein should be construed in the context of suspension or placement within a vertical wellbore, with "upper" meaning nearer a surface location with respect to "lower" and with the understanding that the embodiments may be used in non-vertical wellbores or non-vertical locations within wellbores.

Figure 1:
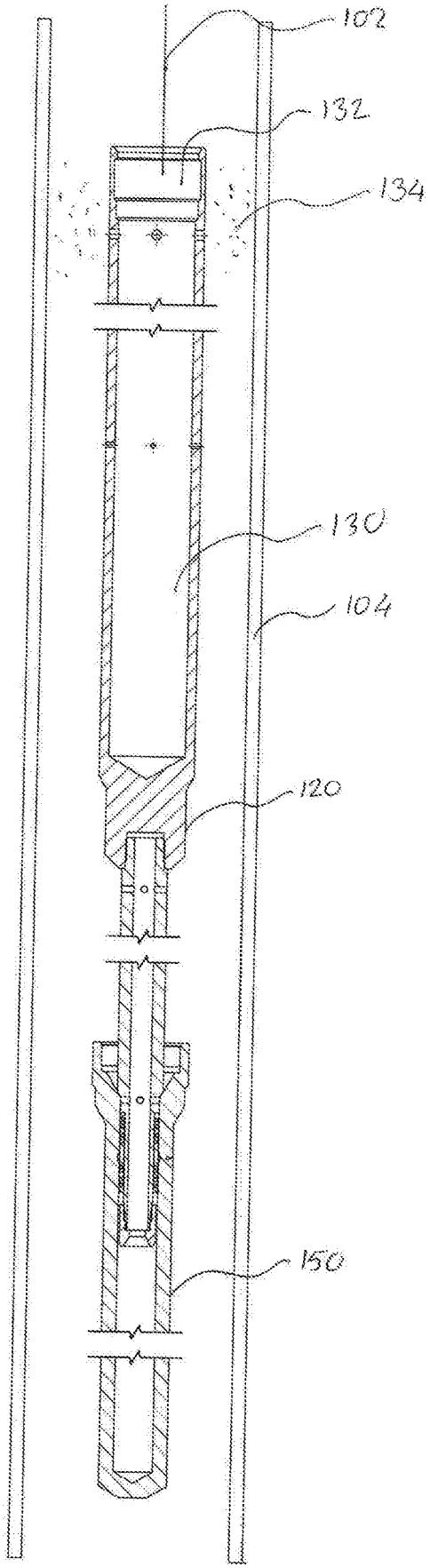
FIG. 1 shows a sealing tool according to one embodiment.

As shown in the embodiment of FIG. 1, a sealing tool 100 comprises a prong 120 and a plug 150. The prong 120 has a larger diameter upper section 130 with an open top 132 configured to operatively connect to a conveyance such as a slickline 102 for placement within (and removal from) a tubing string 104. A cavity 134 in fluid communication with the open top 132 is formed within the upper section 130 and configured to function as a "junk basket" for catching and retaining sand and other debris, when the prong 120 is disposed within the tubing string 104.

Figure 2:
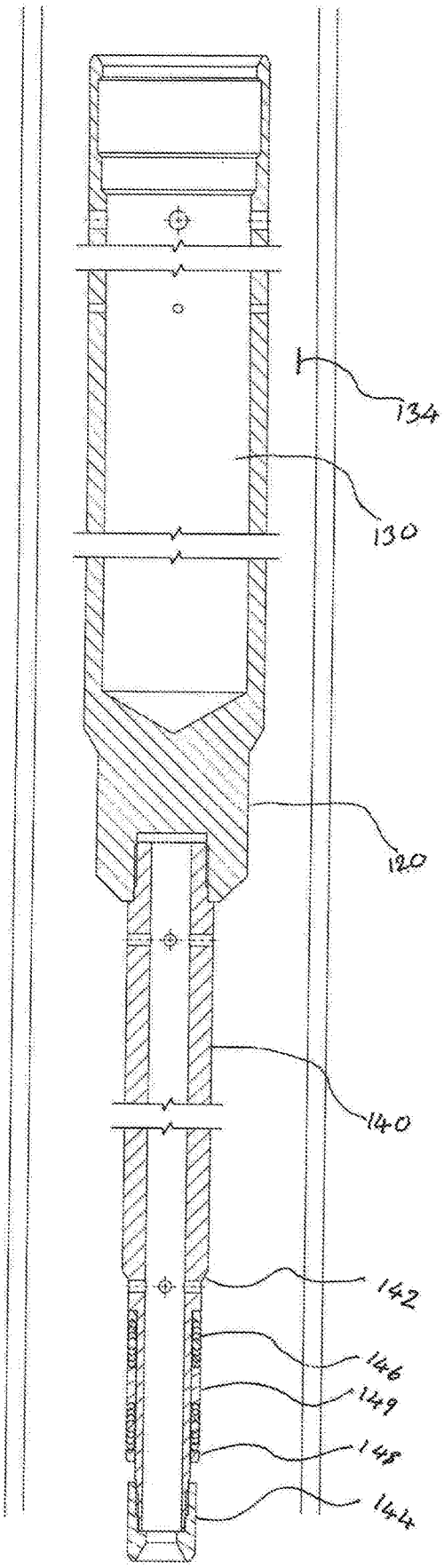
FIG. 2 shows a prong of a sealing tool according to one embodiment.

As shown in the embodiment of FIG. 2, in one embodiment, the cavity 134 of the prong 120 preferably comprises at least 50% of the volume of the upper section 130, and more preferably comprises at least 75% of the volume of the upper section 130. Within various constraints dictated by the size of the prong 120, anticipated volume of debris, characteristics of the slickline 102, operating depth, as well as environmental factors, it is preferable that the volume of the cavity 134 be maximized to advantageously provide for an increased debris capacity.

In one embodiment, the cavity 134 of the prong 120 will have a depth of at least 6" and an inner diameter of at least 2". More preferably, the depth will be at least 8" and the inner diameter at least 2.5". In one embodiment, the capacity of the cavity 134 of the prong 120 will be at least 20 cubic inches, and more preferably at least 30 cubic inches.

The combination of an increased depth and inner diameter advantageously provides for a greater capacity of debris within the cavity 134 of the prong 120. Thus, when the prong 120 is being removed from the plug 150 and the tubing string 104, a greater volume of debris is retained within this cavity 134 and thus prevented from falling into the plug 150 where it might prevent proper connection to the plug 150 for retrieval, as will be discussed in more detail below.

The lower section 140 of the prong 120 comprises a smaller diameter extension operatively connected to the upper section 130. The outer diameter of at least the bottom portion of the lower section 140 will typically be selected to substantially correspond to an inner diameter of the plug 150, such that a close mating relationship can be formed between the prong 120 and the plug 150.

The bottom portion of the lower section 140 of the prong 120 comprises an external shoulder 142, typically tapered, a nose 144, and at least one seal 146 disposed between the external shoulder 142 and the nose 144. The seal 146 may comprise an elastomer and may be secured in a desired location along the perimeter of the bottom portion by one or more retaining elements 148.

In one embodiment, multiple external shoulders 142 may be disposed along an outer surface of the prong 120 to ensure a desired contact with one or more components of the plug assembly or other components disposed within the tubing string 104.

In one embodiment, paired seals 146 are separated by a spacer 149 and disposed at locations selected to correspond to above and beneath one or more equalization holes of the plug 150, as will be later shown and described. Pairing of multiple seals 146 at locations encompassing the equalization holes therebetween will advantageously achieve a more robust seal. Generally, the location of the spacer 149 or similar element separating the seals 146 will be selected to correspond to an anticipated location of the equalization holes of the plug 150.

Seals 146, spacers 149, and retaining elements 148 may be fixedly attached to the surface of the bottom portion 140 of the prong 120, or alternatively may be sized and arranged such that they form a desired configuration between the nose 144 and shoulder 142 capable of rotational displacement around the circumference of the bottom portion of the lower section 140, without significant vertical displacement due to filling substantially all of the surface area between the nose 144 and the shoulder 142.

In one embodiment, the nose 144 may be removed and the seals 146, spacers 149 and/or retaining elements 148 may be replaced or rearranged, advantageously allowing adjustments to the sealing capability of the sealing tool 100, facilitating repairs and/or permitting use of a particular size of prong 120 with multiple sizes of plugs 150.

Preferably, the outer diameter of the nose 144, seals 146, spacers 149 and retaining elements 148 will be substantially identical and substantially uniform from the end of the nose 144 to the beginning of the external shoulder 142. This advantageously decreases the likelihood of any of the components becoming snagged or damaged during use. Alternatively, the outer diameters of the nose 144, seals 146, spacers 149 and/or retaining elements 148 may vary to achieve a desired sealing configuration when oriented with respect to the equalization holes of the plug 150 and/or based on an inner diameter of the plug 150 into which the prong 120 will nest.

Figure 3:
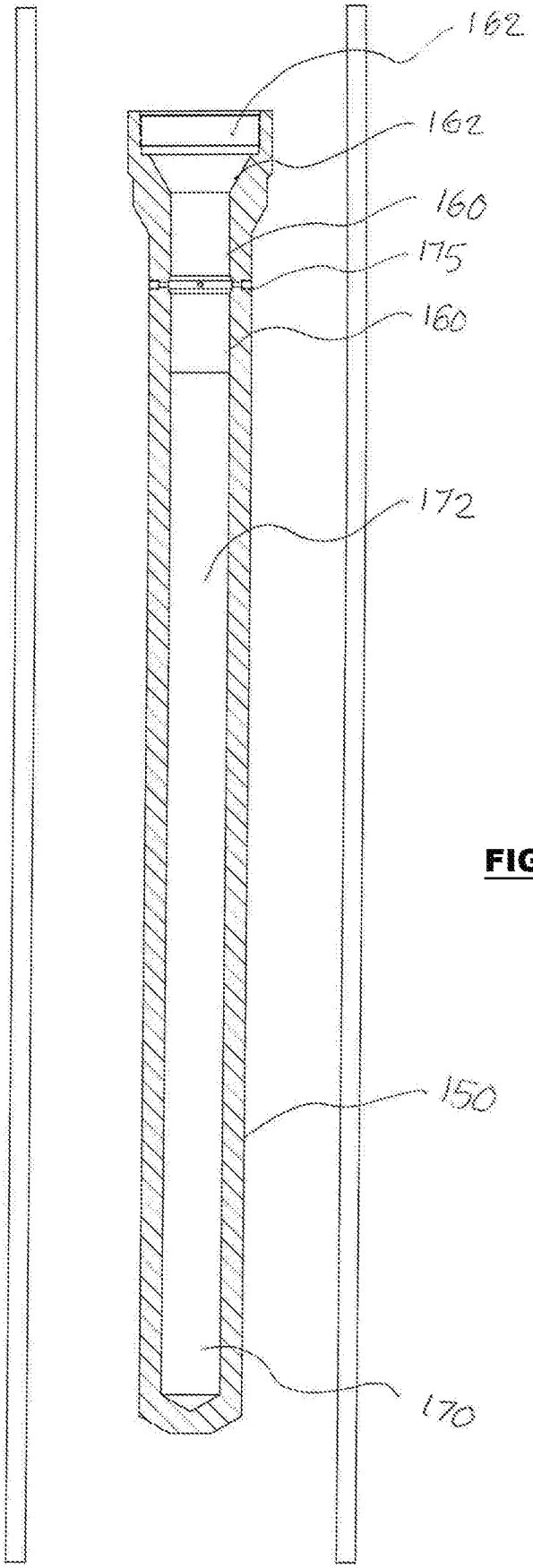
FIG. 3 shows a plug of a sealing tool according to one embodiment.
Figure 4:
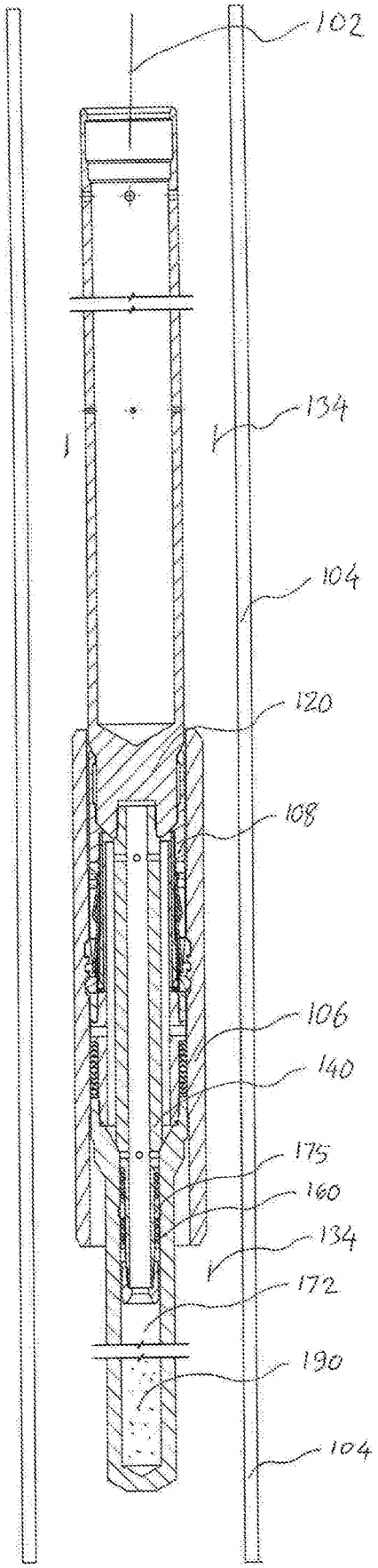
FIG. 4 shows a sealing tool according to one embodiment in use with the plug operatively connected to a lock mandrel.
Figure 5:
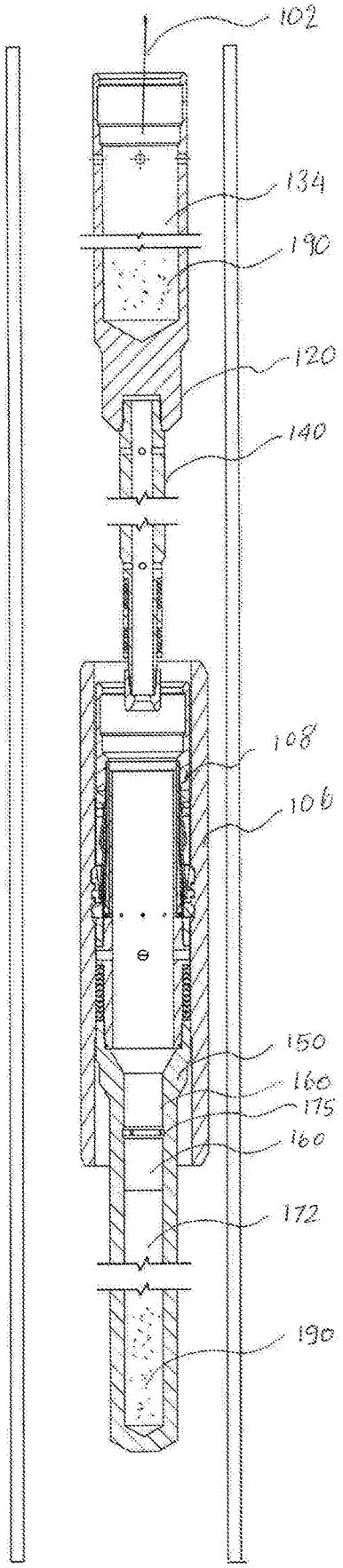
FIG. 5 shows a sealing tool according to one embodiment in use during separation of the prong from the plug.

As shown in the embodiments of FIGS. 3-5, the plug 150 of the sealing tool 100 generally comprises an upper section 160 having an outwardly-tapered open top 161 configured (e.g., externally-threaded) to connect to a component such as a lock mandrel 108 for securing the plug 150 within the tubing string 104. The upper section 160 of the plug 150 includes an internal shoulder 162 or other internal projection configured to prevent further penetration of the prong 120 into the plug 150 when the external shoulder 142 of the prong 120 contacts the internal shoulder 162 of the plug 150.

Alternatively, or in conjunction with the internal shoulder 162 of the plug 150, the fluid interface between the upper section 160 of the plug 150 and the cavity 172 of the lower section 170 of the plug 150 may also include a restriction (e.g., a landing ring), internal projection, or similar configuration for limiting penetration of the nose 144 of the prong 120, advantageously creating a redundant or alternate system for limiting penetration of the prong 120 into the plug 150, while permitting fluid communication between the cavity 172 and the upper portion 160 of the plug 150.

The lower section 170 of the plug 150 comprises a cavity 172 formed therein, in fluid communication with the open top 161 and sealed at the bottom. In one embodiment, the plug 150 may be manufactured from one integral piece, or the bottom may be sealed by a removable cap 174, advantageously facilitating the cleaning of accumulated debris from the cavity 172 when the plug 150 is removed from the wellbore after use.

The cavity 172 of the plug 150 will preferably have a larger internal diameter than that of the upper section 160 of the plug 150. In one embodiment, the inner diameter of the cavity 172 of the plug 150 will be at least 50% of the outer diameter of the lower section 170, and more preferably at least 65% of the outer diameter of the lower section 170.

Similarly, the length of the cavity 172 is preferably at least 50% of the length of the plug 150, and more preferably 60% the length of the plug 150, to advantageously facilitate the settling of sand or other debris into the cavity 172 and thereby lessen the accumulation of sand or other debris in the areas above, where it might interfere with proper penetration of the prong 120 into the plug 150 and thereby prevent proper sealing within the sealing tool 100. Additionally, the greater the depth of the cavity 172 beneath the equalization holes (as discussed in detail below), the less likelihood that debris within the cavity 172 will be disrupted by fluid flow through the equalization holes, thereby undesirably recirculating the debris into the fluid.

In one embodiment, the plug 150 shall have an overall length of at least 20" and an inner diameter of at least 1.6". Preferably, the plug will have an overall length of at least 30" and an inner diameter of at least 1.85". More preferably, the plug 150 will have an overall length of at least 30" and an inner diameter of at least 1.95". To the extent that the upper section 160 of the plug 150 has a different inner diameter than the cavity 172, the preferred inner diameters disclosed are those of the cavity 172.

As the length of the plug 150, particularly the cavity 172, and inner diameter are increased, the capability to retain an increased volume of debris is also increased, advantageously decreasing the likelihood that debris will remain in the area of the plug 150 above the cavity 172 (including within the upper portion 160) which might prevent the prong 120 from becoming fully seated into the plug 150 to seal the equalization holes as will be further discussed in detail below. Preferably the volume of the cavity 172 is at least 50 cubic inches, and more preferably at least 100 cubic inches.

The combined volume of the plug cavity 172 and the prong cavity 134 will preferably be at least 70 cubic inches, for the retention and removal of debris. More preferably, this combined volume will be at least 120 cubic inches. This determines the overall volume of debris that will be prevented from fouling the upper portion 160 of the plug 150 during retrieval operations as well.

At least one equalization hole 175 is disposed in an outer wall of the plug 150, above the cavity 172. The quantity, size and placement of the equalization holes 175 may vary and will generally be selected based upon the size of the plug 150 (which may vary with size of tubing string 104 in a target location), the anticipated fluid pressure in the wellbore at a target location, and other criteria. In one embodiment, equalization holes 175 will be disposed along the circumference of the plug 150 at a location selected to be reliably sealed by the seals 146 of the prong 120. Generally this location will be selected to ensure that the seal(s) 146 are likely to be aligned with, or bracketing, the equalization hole(s) 175.

Preferably the equalization hole(s) 175 will have a circular configuration to permit threading and thereby advantageously facilitate the use of a higher number of equalization hole(s) 175 than may be necessary for a given environment, with the capability of disabling certain holes via the insertion of e.g., threaded inserts. However, the equalization hole(s) 175 may have any configuration known in the art, so long as they are capable of permitting fluid communication between an interior and exterior of the plug 150, above the cavity 172. In one embodiment, the size of the equalization hole(s) 175 will be selected or modifiable to correspond to environmental debris expectations.

In one embodiment, additional equalization holes 175 may also be formed in an upper perimeter of the cavity 172 of the plug 150. Such a configuration would advantageously permit greater flow through the plug 150 when not in a sealing configuration, at the expense of potentially less reliable sealing.

In one embodiment, multiple rows of equalization holes 175 may be formed at a plurality of circumferential locations in the plug 150 above the cavity 172. Typically, the prong 120 will then be correspondingly configured to ensure that the placement of seals 146 and/or spacers 149 will correspond to such placement(s) of the equalization holes 175.

As shown in the embodiment of FIG. 4, in use, the plug 150 will typically be secured within a tubing string 104 via an operative connection with a lock mandrel 108 or similar device, that is secured within the tubing string 104 by connecting to e.g., a nipple 106 disposed within the tubing string 104. Typically the plug 150 and lock mandrel 108 are operatively connected at a surface location and lowered into the tubing string 104 via a conveyance such as a slickline 102.

Once the plug 150 is secured within the tubing string 104, the conveyance 102 is disconnected and removed from the wellbore. Fluid flow through the location of the plug 150 may continue at this time, via the fluid connection through the equalization holes 175 of the plug 150. Sand and other debris 190 that settles out of the fluid above the plug location (and fluid flowing through the equalization holes 175) will advantageously settle into the cavity 172 of the plug 150, instead of settling within the upper portion 160 where it would otherwise interfere with proper penetration of the prong 120 into the plug 150, as required to reliable seal the plug 150.

The prong 120 is secured to the conveyance 102 at a surface location and then lowered into the tubing string 104 until the lower section 140 of the prong 120 penetrates into the upper portion 160 of the plug 150, thereby blocking the equalization holes 175 of the plug 150 to block fluid flow therethrough and thereby seal the tubing string 104 at the plug location. At this point the conveyance 102 may be disconnected from the prong 120 and the plug 150 will continue to hold pressure from both above and below.

Once the tubing string 104 is sealed by the sealing tool 100, pressure testing and other operations that rely upon a sealed tubing string 104 may be conducted. Debris 190 that may settle from above the sealing tool 100 will advantageously be retained within the cavity 134 of the prong 120, preventing interference with retrieval operations of the sealing tool 100 and facilitating removal of such debris 190 from the tubing string 104 as the sealing tool 100 is disconnected and removed from the tubing string 104.

As shown in the embodiment of FIG. 5, as the prong 120 is disconnected from the plug 150, both the cavity 134 of the prong 120 and the cavity 172 of the plug 150 will advantageously function as "junk baskets," collecting any debris 190 that may settle from above the prong 120, and above the plug 150, including between the prong 120 and the plug 150 during the prong retrieval process. The high capacity of the plug cavity 172 permits a significant volume of debris 190 to settle beneath the level of the upper plug 160 and lock mandrel 108, advantageously preventing the blockage by debris 190 of the upper plug 160 and lock mandrel 108 to facilitate retrieval and ensure more reliable connection of the conveyance 102 during retrieval.

In one embodiment, the plug 150 and lock mandrel 108 may be combined into a single unit to both operatively connect to a landing nipple 106, and seal the downhole location when the equalization holes 175 of the combined unit are blocked by the longitudinal extension 140 of the prong 120. Such a configuration advantageously simplifies and accelerates operations by removing the steps of connecting and disconnecting the lock mandrel 108 from the plug 150.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations.

While the above detailed description has shown, described, and pointed out novel features as applied to various embodiments, it can be understood that various omissions, substitutions, and changes in the form and details of the devices or illustrated can be made without departing from the spirit of the disclosure. As can be recognized, certain embodiments described herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. A sealing tool for a subsurface tubing string, comprising:

a prong comprising an upper cavity having a substantially open top, a lower extension, and an external shoulder disposed therebetween, a plug comprising an open upper section configured to receive a portion of a longitudinal extension of the prong, and a lower section comprising a cavity in fluid communication with the open upper section;

at least one equalization hole disposed through a wall of the plug above the plug cavity and providing fluid communication between an interior of the plug, and an exterior thereof; and wherein an outer diameter of at least a bottom portion of the lower extension of the prong is selected to substantially correspond to an inner diameter of the plug proximal the at least one equalization hole, such that a close mating relationship may be formed between the plug and prong.

2. The sealing tool of claim 1, wherein the bottom portion of the lower extension of the prong comprises a nose and at least one seal.

3. The sealing tool of claim 2, further comprising at least one spacer disposed between a pair of seals.

4. The sealing tool of claim 2, wherein a distance between the at least one seal and the external shoulder of the prong is substantially identical to a distance between the at least one equalization hole and an internal shoulder of the upper section of the plug.

5. The sealing tool of claim 1, wherein the upper section of the plug comprises threads for operatively connecting to a lock mandrel.

6. The sealing tool of claim 1, wherein the at least one equalization hole comprises a plurality of equalization holes disposed equidistantly along a circumference of the plug.

7. The sealing tool of claim 1, wherein the at least one equalization hole comprises internal threads.

8. The sealing tool of claim 1, further comprising a removal cap disposed at the bottom of the cavity of the plug.

9. The sealing tool of claim 1, wherein the cavity of the prong comprises at least 50% of the volume of an upper portion of the prong.

10. The sealing tool of claim 1, wherein the cavity of the plug comprises at least 50% of the volume of the lower section of the plug.

* * * * *